United States Patent [19]

Usher

[11] 4,027,822

[45] June 7, 1977

[54] ATTACHMENT DEVICE FOR A SHOWER UNIT

[76] Inventor: George William Usher, 41, Harlech Road, Leeds 11 Yorkshire, England

[22] Filed: Aug. 25, 1975

[21] Appl. No.: 607,533

[52] U.S. Cl. ..... 239/305; 239/310; 239/317; 137/268

[51] Int. Cl.[2] ..... B05B 7/28

[58] Field of Search ..... 239/305, 310, 315, 316, 239/317; 222/193; 4/225, 226; 137/268

[56] References Cited

UNITED STATES PATENTS

| | | | |
|---|---|---|---|
| 514,253 | 2/1894 | Boas | 239/315 X |
| 1,561,039 | 11/1925 | Walker | 239/317 X |
| 2,189,936 | 2/1940 | Brandfon | 239/310 X |
| 3,091,402 | 5/1963 | Palmer | 239/317 X |
| 3,713,585 | 1/1973 | Conklin | 239/310 X |

*Primary Examiner*—John J. Love
*Attorney, Agent, or Firm*—Fred Philpitt

[57] ABSTRACT

A device for introducing liquid additive into water flowing through a feed pipe of a domestic shower, wherein the device has a short length of pipe which is connected in the feed pipe, and is provided with means whereby some of the water flowing through the short pipe is deflected into a mixing chamber, wherein it mixes with the additive, and the mixture is fed back into the short length of pipe to join the main stream of water. The water is deflected into said cavity downstream of where the mixture returns to the interior of the short pipe, so that there is sufficient delay in the return of the water to the mainstream to effect mixing of the additive with the water in said chamber.

7 Claims, 3 Drawing Figures

ATTACHMENT DEVICE FOR A SHOWER UNIT

Attachment devices for shower units are known and comprise a means for introducing an additive such as bubble bath fluid, perfume, disinfectant, deodorizer, medication or the like into the water feed to the shower units, rose or spray nozzle.

By and large, these known devices operate to squirt the additives into the water flow, or else the additive is induced into the water flow by virtue of the momentum of the flow, or of a jet or region of high velocity created in the flow for such purpose. In another known arrangement, a portion of the flow of the water is branched into a chamber in the device and into which the additive is introduced, and the diverted water, now containing or mixed with the additive, is returned to the main flow leading to the shower, rose or spray nozzle.

In all of these arrangements it is, without exception, difficult to control the rate at which the additive is used up, or issues from the rose or nozzle along with the water. Generally speaking, the additive is used up at a far higher rate than it need be and consequently there is much wastage. My aim is to provide an attachment device for a shower by which additive can be introduced into the shower water flow more slowly and evenly than has been possible with the devices known heretofore.

According to one aspect of the present invention there is provided an attachment device for a shower unit, said device comprising a casing in which is located a tube having connection means at each end whereby the tube can be connected into the supply path along which water flows to the exit port of the shower, a mixing chamber in the casing, deflection means in the tube lying in the path of flow of water through the tube so as to deflect some of such water into the mixing chamber, at least one aperture in the tube which permits the return of water back to the flow through the inside of the tube, means permitting additive to be injected into said mixing chamber to be mixed with water deflected thereinto said deflection means and aperture or apertures being spaced axially of the tube so that in use water deflected into the chamber circulates back into the flow in the tube before the flow encounters said deflection means.

Preferably, the mixing chamber surrounds the tube, and is partially defined by said tube and partially defined by said casing.

In another aspect of the invention, the device is usable with an existing tube, and in accordance with the other aspect of the invention there is provided an attachment device for a shower unit, said device comprising a casing adapted to surround and sealingly engage a length of tube through which water flows to the exit port of the shower, a mixing chamber in the casing, and means permitting additive to be injected into said mixing chamber, the arrangement being that by providing said length of the tube with deflection means and return aperture means so that the water flow through the tube passes the aperture means before it encounters the deflection means, and by connecting the device to said length of tube, water deflected from the flow by the deflection means enters the mixing chamber where it mixes with the additive and re-enters the flow in the tube through said aperture means.

The deflection means is preferably defined by indented portions of the tube wall.

The means permitting additive to be injected into the mixing chamber may comprise a passage or passages in the casing, and may also include a one-way valve in the passage or each of the passages.

The or each passage preferably leads to a connector formation to which a receptacle for a supply of additive may be connected.

The casing may have a vent hole leading from the chamber to atmosphere, such hole having a oneway valve allowing air to be drawn into the chamber to prevent the formation of a vacuum therein, but prevent leakage of water from the chamber through the hole.

An embodiment of the present invention will now be described by way of example, with reference to the accompanying drawings, wherein.

Figure 3:
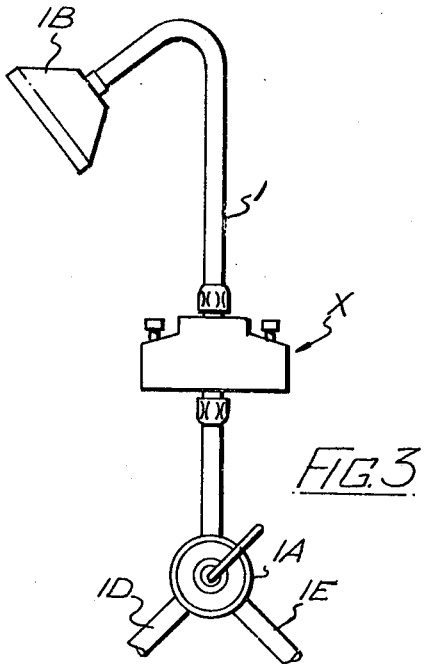
FIG. 3 shows diagrammatically one example of a shower unit fitted with a device as illustrated in FIGS. 1 and 2.

Referring to the drawings, the device is positioned in and secured to the riser pipe 1 of a shower unit which may have, for example as illustrated in FIG. 3, a mixing valve 1A at the lower end of the riser pipe 1 and a shower rose 1B at the top end of pipe 1 as is conventional practice. The mixer valve 1A serves to control the quantities of hot and cold water which are delivered through pipes 1D and 1E to pipe 1 and eventually to rose 1B. The device, which is indicated generally by the letter X in FIG. 3, is shown as being connected in the pipe 1.

In effect, the interior of the pipe 1 constitutes a passageway through which liquid, in this case a mixture of hot and cold water, or in some cases simply cold water or simply hot water, is passing and by inserting the device according to the invention, the device in fact defines a length of this passage through which the liquid flows.

Figure 1:
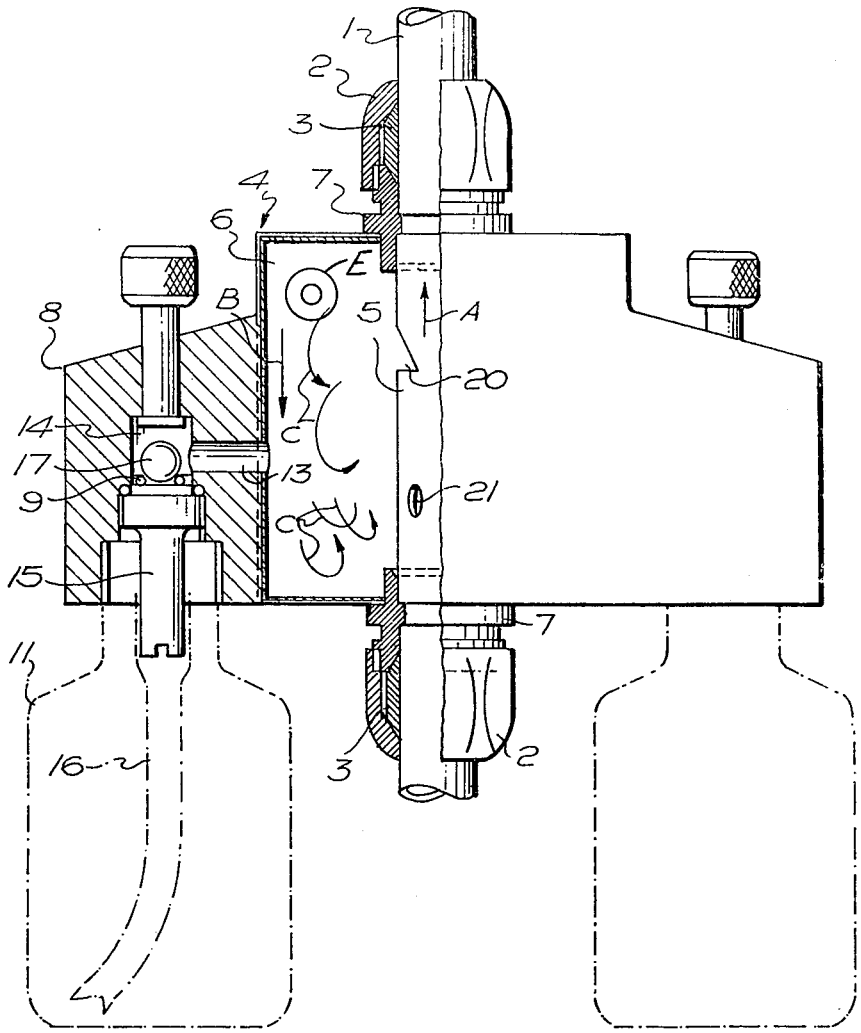
FIG. 1 is a half sectional elevation of a device according to the invention when fitted in the feed water pipe of a shower.
Figure 2:
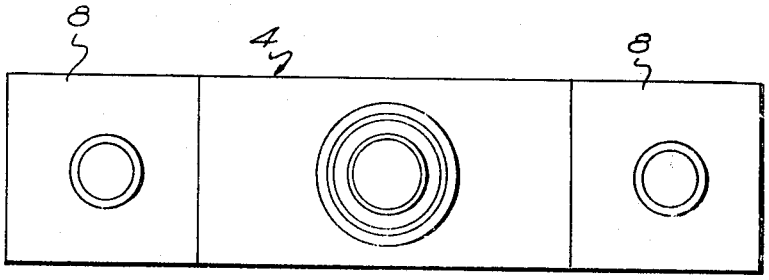
FIG. 2 is a plan of the device shown in FIG. 1.

Referring in more detail to FIGS. 1 and 2, the device comprises a casing, in this example of metal, which is made up of a hollow box portion 4 having two diametrically opposed and outwardly extending integral block portions 8.

Within the hollow box portion 4 is a small tube 5 of a diameter less than the interior width of the portion 4. This tube which is open ended and is held in position centrally of the portion by means of end spacing washers 7 screwed to the top and bottom of portion 4 so that within the casing and surrounding the tube 5 is a cavity 6 which will be referred hereinafter to as the "mixing cavity". There is a vent passage leading from chamber 6 to atmosphere, such vent passage having a one-way valve to allow air to be drawn into the chamber 6 to prevent the formation of a vacuum therein when there is no flow through the device, but which prevents leakage of water out of the vent passage when there is flow through the device.

Washers 7 have through bores to enable liquid passing along pipe 1 to continue through tube 5 and into the other section of pipe 1 and these flanges also have screwed hub portions by which gland nuts 2 may be screwed thereto in order to compress resilient annular seals 3 on to the pipe 1 to form liquid tight seals between the pipe 1 and the flanges 7.

The direction of flow through pipe 5 is indicated by arrow A.

The interior of pipe 5 communicates with mixing chamber 6 by means of downstream apertures 20 and upstream apertures 21 in the wall of tube 5. The downstream apertures 20 are formed by slitting the wall and then indenting same as shown whereas apertures 21 are simply circular holes in the tube wall. Formation of the apertures 20 in the manner described defines deflection means which force some of the liquid passing up the pipe 1 into the mixing cavity 6 for a purpose to be explained hereinafter.

Each block portion 8 is provided with a threaded bore into which a flexible container 11 having a screwed neck portion may be screwed, as shown in FIG. 1, and the block portion 8 also houses a one-way air intake valve (not shown) by which air can be drawn into container 11 as will be explained hereinafter.

Each block 8 also carries a short rigid pipe 15 extending into and located centrally of the threaded bore and to this pipe 15 is attached a tip tube 16 of flexible material which extends to the bottom of the flexible bottle 11. The interior of pipe 15 leads through a first passage in block portion 8 to a cavity 14 in the block portion and in which is contained a one-way valve ball 17 which normally seats on a circular seat 9. A second and radial passage 13 leads from cavity 14 through block portion 8 to the interior of the box portion 4 whereby said passage 13 communicates with the mixing cavity 6.

Each valve ball 17 is associated with a slidable locking pin 18 which can be pushed downwards to hold the ball 17 firmly on the associated seat 9. This prevents leakage back into the container 11 when the device is not in use. Of course, the ball 17 acts as a one-way valve as it falls to the closing position on seat 9 under gravity.

The casing may also be provided with an additional support fork by which a further plastic bottle may be supported. Such further bottle may contain, for example, hair shampoo to be delivered through a suitably shaped dispensing cap into the hand by squeezing the container shown in outline in the figure. The shampoo would then be applied directly to the hair.

The operation of the device is straightforward. Each of the bottles 11 will carry a suitable solution or fluent material which is desired to be introduced into the water stream flowing through pipe 1 to the shower rose 1B. Assume that one of the bottles contains bubble bath liquid. In order to insert some of this liquid into the water stream, the appropriate bottle simply is squeezed by hand resulting in closure of the associated air intake valve and the ejection of a quantity of liquid past one-way valve 17 and into mixing cavity 6. Some of the water flowing along the inside of pipe 5 is deflected by the indented tube portions 20 into chamber 6 where it mixes with the bubble bath liquid and generally travels in the direction of arrow B through chamber 6 to and out of holes 21, but there is a general swirling of the water in chamber 6 as indicated by arrows C. The water and bubble bath mixture passes through the holes 21 back into the main stream and is carried towards the rose or nozzle of the shower. Some of the mixture however will again be deflected by portions 20 back into chamber 6 and so a continual recycling takes place. The result is that there is a gradual withdrawal of the liquid containing the bubble bath solution into the main water stream and there is a gradual consumption of the solution. Thus, the solution is carried to and ejected from the rose 1B entrained with the supply water in much less concentration as compared with known arrangements.

To insert the device of FIGS. 1 and 2 into an existing shower unit, spray unit or even a garden hose, one method is to sever the hose or pipe and remove a length approximately equal to the length of tube 5, if the pipe is of a rigid material, and is otherwise securely mounted on a wall or other surface, or if the pipe is of flexible material or not securely fixed, then it need only be severed transversely and the ends moved apart and secured to the fittings 7 and 3 at the ends of the pipe 5.

Where the pipe has a natural connection with, for example a mixing valve or a shower rose, it may not be necessary to sever the pipe at all if the device can be attached at the natural connection point of the pipe with some other part of the system.

In another embodiment of the invention each bottle 11 is provided with a cap which has a one-way air intake valve E in the housing, and the bottle and its can are carried by the flexible dip tube 16 and are spaced slightly from the block portion 8. Thus, the user of this device cannot only squeeze the bottle to cause ejection of the liquid but can also tilt the bottle from side to side lessening the amount by which a user of the device must bend to squeeze the bottle.

The device according to the invention as illustrated is preferably constructed of metal but may be partially constructed of synthetic plastics material.

It will be appreciated that the use of the device is not essentailly restricted to shower units. Thus, for example, it could be inserted in a wash hose in a washing unit for example for a motor vehicle which comprises a hose and a washing brush at the end thereof. Where the unit has a different use then, of course, the plastic bottle will contain the appropriate medium for that use. Thus, in washing motor vehicles the bottle may contain a strong detergent which would not be suitable in the use of the device in a shower unit for human beings.

Although the device in each example is shown as having the tube 5, which becomes part of the passageway carrying the main stream of liquid, this construction is not essential to the invention. In some examples, the casing may be unhingeable or separate parts which are sealingly clamped round the pipe so that a cavity in the casing communicates with the interior of the pipe through one or more holes and deflection means provided in the pipe.

Also, it may be possible to use other feed means than the plastic bottles shown in the examples. The feed means may therefore comprise hand operated plungers operating through one-way valve arrangements to inject the fluent medium into the mixing cavity.

In a modified arrangement, only one of the bottles 11 is adapted as described to insert fluent additive into the water stream, whilst the other may carry for example hair shampoo. In this case squeezing of the hair shampoo would cause dispensing of a quantity of shampoo, or other medium as desired, out of an outwardly located aperture of the block portion 8. The quantity so dispensed would be caught by the hand for direct application to the hair, in the case where the bottle contains hair shampoo.

There may be a manually operable leakage valve connected in pipe 1 below the device so that selectively, standing water in the device and pipe 1 can be leaked away. This prevents gradual back leakage of water into the bottles 11 when the device is not in use.

What I claim is:

1. An attachment device for a shower unit, said device comprising a casing in which is located a tube having connection means at each end whereby the tube can be connected into the supply path along which water flows to the exit port of the shower, a mixing chamber in the casing, deflection means in the tube lying in the path of flow of water through the tube so as to deflect some of such water into the mixing chamber, at least one aperture in the tube which permits the return of water back to the flow through the inside of the tube means permitting additive to be injected into said mixing chamber to be mixed with water deflected thereinto, said deflection means and aperture or apertures being spaced axially of the tube so that in use water deflected into the chamber circulates back into the flow in the tube before the flow encounters said deflection means.

2. An attachment device according to claim 1, wherein the deflection means is defined by indented portions of the tube wall.

3. An attachment device for a shower unit, said device comprising a casing adapted to surround and sealingly engage a length of tube through which water flows to the exit port of the shower, a mixing chamber in the casing, and means permitting additive to be injected into said mixing chamber, the arrangement being that by providing said length of the tube with deflection means and return aperture means so that the water flow through the tube passes the aperture means before it encounters the deflection means, and by connecting the device to said length of tube, water deflected from the flow by the deflection means enters the mixing chamber where it mixes with the additive and re-enters the flow in the tube through said aperture means.

4. An attachment device according to claim 3, wherein the mixing chamber surrounds, or in use surrounds, the tube and is partially defined by the casing and partly by the tube.

5. An attachment device according to claim 3, wherein the means permitting additive to be injected into the mixing chamber comprises a passage or passages in the casing and a one-way valve in the or each of the passages.

6. An attachment device according to claim 5, wherein the or each passage leads to a connector formation, to which a receptacle for a supply of additive may be connected.

7. An attachment device according to claim 1, wherein the casing has a vent hole leading from the chamber to atmosphere, such hole having a one-way valve allowing air to be drawn into the chamber to prevent the formation of a vacuum therein but prevent leakage of water from the chamber through the hole.

* * * * *